US006510616B1

(12) United States Patent
Sparkman

(10) Patent No.: US 6,510,616 B1
(45) Date of Patent: Jan. 28, 2003

(54) ADJUSTABLE TEMPLATE TOOL FOR STAIRWAYS

(76) Inventor: James E. Sparkman, 621 2nd St., Georgetown, KY (US) 40324

( * ) Notice: Subject to any disclaimer, the term of this patent is extended or adjusted under 35 U.S.C. 154(b) by 0 days.

(21) Appl. No.: 09/770,267

(22) Filed: Jan. 26, 2001

(51) Int. Cl.[7] ..... B43L 7/027; B43L 7/12; B43L 7/14

(52) U.S. Cl. ..... 33/460; 33/456

(58) Field of Search ..... 33/459–464, 415, 33/442, 456, 418–419

(56) References Cited

U.S. PATENT DOCUMENTS

| | | | | | |
|---|---|---|---|---|---|
| 164,008 | A | | 6/1875 | Kirkpatrick | |
| 330,378 | A | * | 11/1885 | Colt | 33/460 |
| 371,210 | A | * | 10/1887 | Naramore | 33/461 |
| 787,172 | A | * | 11/1905 | Hasson | 33/460 |
| 1,015,773 | A | | 1/1912 | Auger | |
| 1,053,757 | A | * | 2/1913 | Tucker | 33/460 |
| 1,157,514 | A | * | 10/1915 | Earl | 33/463 |
| 1,261,596 | A | * | 4/1918 | Murvine | 33/462 |
| 1,324,624 | A | * | 12/1919 | Seay | 33/460 |
| 1,349,348 | A | * | 8/1920 | Thielman | 33/461 |
| 1,489,789 | A | * | 4/1924 | Ryan | 33/461 |
| 1,514,323 | A | * | 11/1924 | Kirchner | 33/460 |
| 1,524,392 | A | * | 1/1925 | East | 33/460 |
| 2,686,973 | A | * | 8/1954 | Christianson et al. | 33/461 |
| D220,061 | S | | 3/1971 | Kerns | |
| 3,888,477 | A | | 6/1975 | Tate | |
| 4,882,846 | A | | 11/1989 | Reed | |
| 4,955,141 | A | * | 9/1990 | Welch | 33/418 |
| 5,323,541 | A | | 6/1994 | Burnham | |

FOREIGN PATENT DOCUMENTS

| | | | | |
|---|---|---|---|---|
| GB | 426080 | * | 3/1935 | 33/458 |
| JP | 55074401 A | * | 5/1980 | 33/456 |

* cited by examiner

*Primary Examiner*—Diego Gutierrez
*Assistant Examiner*—Gail Verbitsky

(57) ABSTRACT

An adjustable template tool for stairways for speeding up and simplifying stair layouts. The adjustable template tool for stairways includes an elongate support assembly; and also includes a stair riser template member being adjustably mounted to the elongate support assembly with a fastening member; and also includes a stair tread template member being adjustably mounted to the elongate support assembly with a fastener.

10 Claims, 2 Drawing Sheets

10
29
28
2

25
31
18
13
21
23
14
17
16
15
33
2
20
30
27
12
32
21
11
22
24
26

20
16
19
22
28
18
21
17
21
15
11
27
14
12
33
13

ADJUSTABLE TEMPLATE TOOL FOR STAIRWAYS

BACKGROUND OF THE INVENTION

1. Field of the Invention

The present invention relates to a stairway-building template and more particularly pertains to a new adjustable template tool for stairways for speeding up and simplifying stair layouts.

2. Description of the Prior Art

The use of a stairway-building template is known in the prior art. More specifically, a stairway-building template heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,882,846; 1,015,773; 3,888,477; 5,323,541; U.S. Pat. No. 164,008; and U.S. Pat. No. Des. 220,061.

While these devices fulfill their respective, particular objectives and requirements, the aforementioned patents do not disclose a new adjustable template tool for stairways. The inventive device includes an elongate support assembly; and also includes a stair riser template member being adjustably mounted to the elongate support assembly with a fastening member; and also includes a stair tread template member being adjustably mounted to the elongate support assembly with a fastener.

In these respects, the adjustable template tool for stairways according to the present invention substantially departs from the conventional concepts and designs of the prior art, and in so doing provides an apparatus primarily developed for the purpose of speeding up and simplifying stair layouts.

SUMMARY OF THE INVENTION

In view of the foregoing disadvantages inherent in the known types of stairway-building template now present in the prior art, the present invention provides a new adjustable template tool for stairways construction wherein the same can be utilized for speeding up and simplifying stair layouts.

The general purpose of the present invention, which will be described subsequently in greater detail, is to provide a new adjustable template tool for stairways which has many of the advantages of the stairway-building template mentioned heretofore and many novel features that result in a new adjustable template tool for stairways which is not anticipated, rendered obvious, suggested, or even implied by any of the prior art stairway-building template, either alone or in any combination thereof.

To attain this, the present invention generally comprises an elongate support assembly; and also includes a stair riser template member being adjustably mounted to the elongate support assembly with a fastening member; and also includes a stair tread template member being adjustably mounted to the elongate support assembly with a fastener.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new adjustable template tool for stairways which has many of the advantages of the stairway-building template mentioned heretofore and many novel features that result in a new adjustable template tool for stairways which is not anticipated, rendered obvious, suggested, or even implied by any of the prior art stairway-building template, either alone or in any combination thereof.

It is another object of the present invention to provide a new adjustable template tool for stairways which may be easily and efficiently manufactured and marketed.

It is a further object of the present invention to provide a new adjustable template tool for stairways which is of a durable and reliable construction.

An even further object of the present invention is to provide a new adjustable template tool for stairways which is susceptible of a low cost of manufacture with regard to both materials and labor, and which accordingly is then susceptible of low prices of sale to the consuming public, thereby making such adjustable template tool for stairways economically available to the buying public.

Still yet another object of the present invention is to provide a new adjustable template tool for stairways which provides in the apparatuses and methods of the prior art some of the advantages thereof, while simultaneously overcoming some of the disadvantages normally associated therewith.

Still another object of the present invention is to provide a new adjustable template tool for stairways for speeding up and simplifying stair layouts.

Yet another object of the present invention is to provide a new adjustable template tool for stairways which includes an elongate support assembly; and also includes a stair riser template member being adjustably mounted to the elongate support assembly with a fastening member; and also includes a stair tread template member being adjustably mounted to the elongate support assembly with a fastener.

Still yet another object of the present invention is to provide a new adjustable template tool for stairways that is easy and convenient to use.

Even still another object of the present invention is to provide a new adjustable template tool for stairways that saves the user substantially time and effort in laying out and fabricating the stairs.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
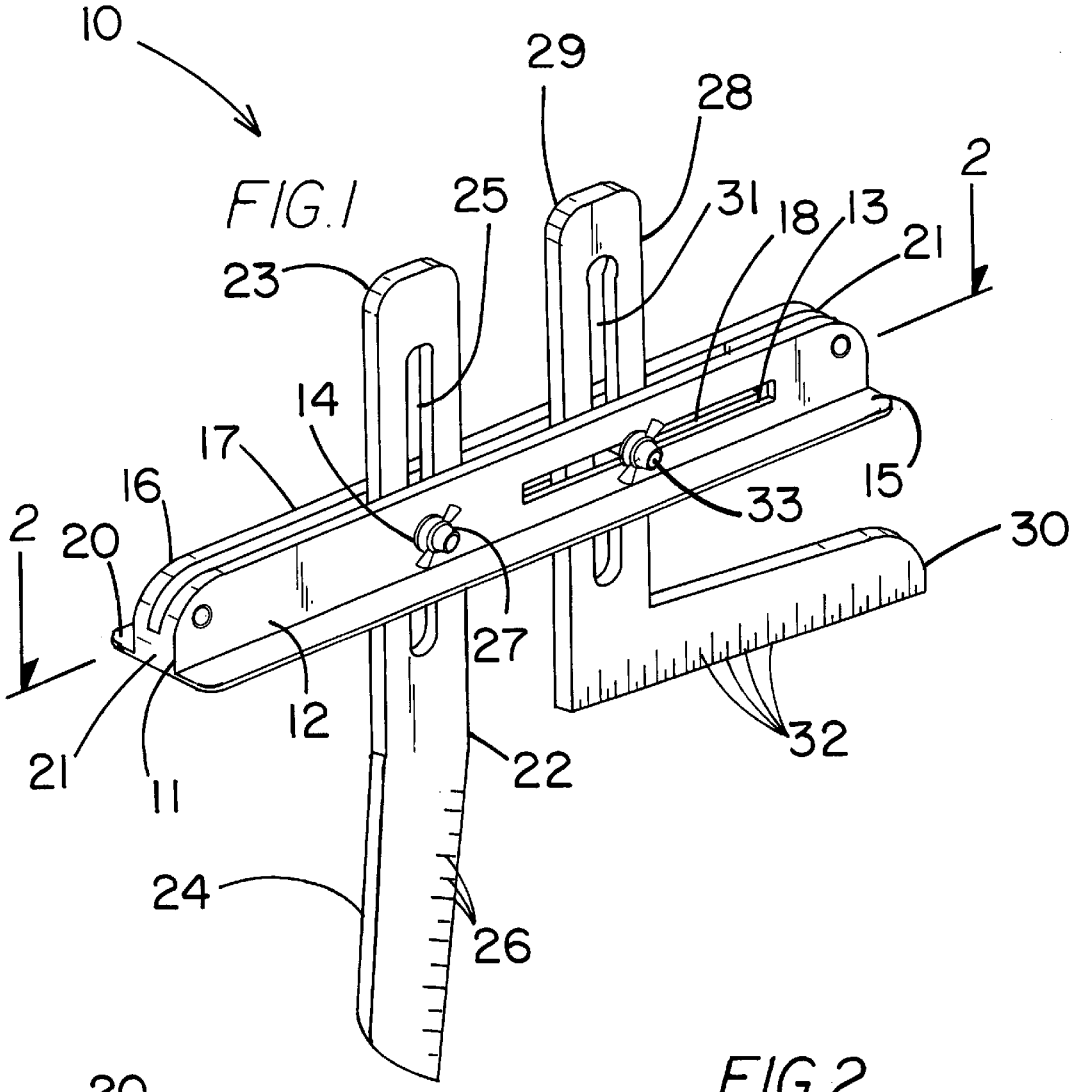
FIG. 1 is a perspective view of a new adjustable template tool for stairways according to the present invention.
Figure 2:
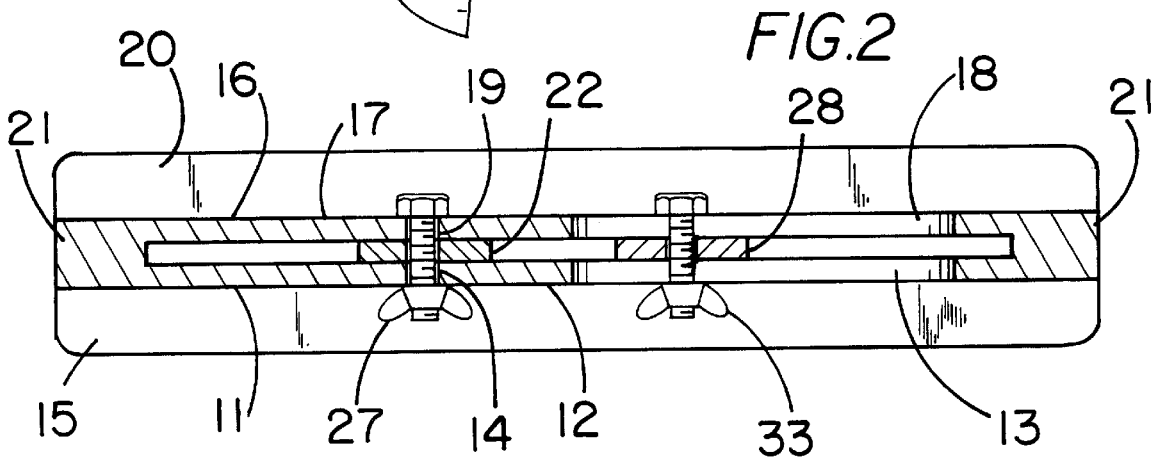
FIG. 2 is a longitudinal cross-sectional view of the present invention.
Figure 3:
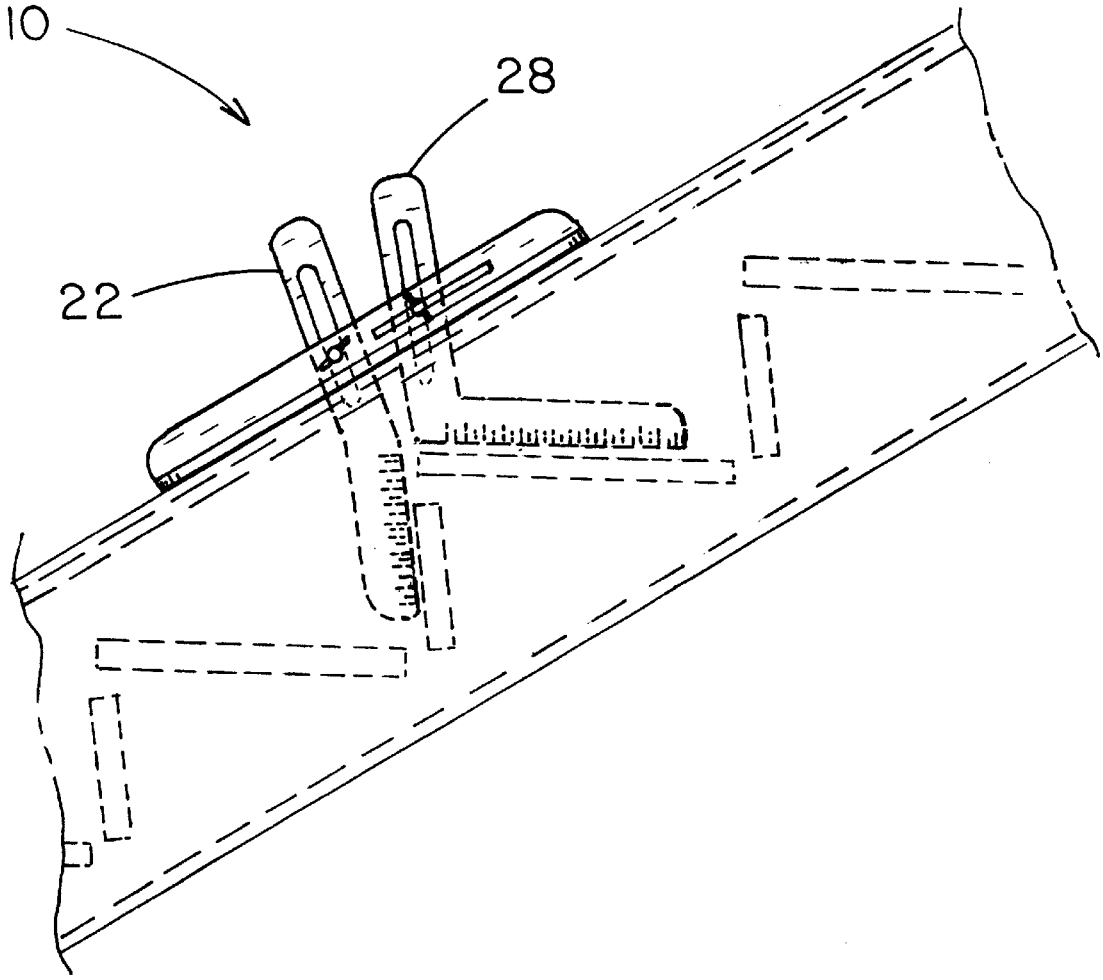
FIG. 3 is side elevational view of the present invention shown in use.

With reference now to the drawings, and in particular to FIGS. 1 through 3 thereof, a new adjustable template tool for stairways embodying the principles and concepts of the present invention and generally designated by the reference numeral 10 will be described.

As best illustrated in FIGS. 1 through 3, the adjustable template tool for stairways 10 generally comprises an elongate support assembly including a first and second elongate support members 11,16 with each including a main wall 12,17 having upper rounded corners, and also including a longitudinal slot 13,18 being disposed through an end portion of the main wall 13,17, and further including a hole 14,19 being disposed through another end portion of the main wall 12,17, and also including spacer members 21 being conventionally disposed between the first and second elongate support members 11,16 with the first and second elongate support members 11,16 being spaced apart and being fastened to another. Each of the first and second elongate support members 11,16 further includes a longitudinal flange 15,20 conventionally extending outwardly from a bottom of the respective main wall 12,17 and extending along a length of the main wall 12,17 with each of the first and second elongate support members 11,16 having a length of approximately 12 inches and a width of approximately 1½ inches.

A stair riser template member 22 is adjustably mounted to the elongate support assembly with a fastening member 27. The stair riser template member 22 includes an elongate handle portion 23 and an elongate blade portion 24 which is integrally attached to an end of the elongate handle portion 23 and which is angled relative to the elongate handle portion 23. The stair riser template member 22 has a longitudinal slot 25 being disposed through the elongate handle portion 23 with the elongate handle portion 23 being disposed between the first and second elongate support members 11,16 and with the fastening member 27 being disposed in the longitudinal slot 25 of the stair riser template member 22 and being disposed through the holes 14,19 of the first and second elongate support members 11,16. The elongate blade portion 24 includes a plurality of measurement markings 26 being spaced along a longitudinal edge thereof.

A stair tread template member 28 is adjustably mounted to the elongate support assembly with a fastener 33. The stair tread template member 28 includes an elongate handle portion 29 and an elongate blade portion 30 which is integrally attached to an end of the elongate handle portion 29 and which is angled relative to the elongate handle portion 29. The stair tread template member 28 has a longitudinal slot 31 being disposed through the elongate handle portion 29 with the elongate handle portion 29 being disposed between the first and second elongate support members 11,16 and with the fastener 33 being disposed in the longitudinal slot 31 of the stair tread template member 28 and being disposed through the longitudinal slots 13,18 of the first and second elongate support members 11,16. The elongate blade portion 30 includes a plurality of measurement markings 32 being spaced along a longitudinal edge thereof.

In use, the user adjusts the settings of the stair riser and tread template members 22,28 as desired and slides the adjustable template tool 10 along a stringer to draw the cut lines for laying out the stairs.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An adjustable template tool for stairways comprising:

an elongate support assembly;

a stair riser template member being pivotally mounted to said elongate support assembly with a fastening member; and a stair tread template member being pivotally mounted to said elongate support assembly with a fastener;

wherein each of said template members has an elongate handle portion and an elongate blade portion, longitudinal axes of said handle and blade portions of each of said template members being oriented at an angle with respect to each other, said handle portion and said blade portion of each of said template members being fixedly connected to each other such that said angle between the longitudinal axes of said portions of each of said template members are unchangeable.

2. An adjustable template tool for stairways as described in claim 1, wherein said elongate support assembly includes a first and second elongate support members with each including a main wall, and also including a longitudinal slot being disposed through an end portion of said main wall, and further including a hole being disposed through another end portion of said main wall, and also including spacer members being disposed between said first and second elongate support members with said first and second elongate support members being spaced apart and being fastened to each other.

3. An adjustable template tool for stairways as described in claim 2, wherein each of said first and second elongate support members further includes a longitudinal flange extending outwardly from a bottom of said respective main wall and extending along a length of said main wall.

4. An adjustable template tool for stairways as described in claim 1, wherein each of said template members are pivotable about a respective pivot point, a pivot point of said stair riser template member being fixed at a position along a longitudinal axis of said support assembly and a pivot point of said stair tread template member being adjustable along the longitudinal axis of said support assembly such that a distance between the pivot point of said stair riser template member and the pivot point of said stair tread template member is adjustable.

5. An adjustable template tool for stairways as described in claim 1, wherein said stair riser template member has a longitudinal slot being disposed through said elongate handle portion with a fastening member being disposed in said longitudinal slot of said stair riser template member and being disposed through a hole in said support member.

6. An adjustable template tool for stairways as described in claim 1, wherein said elongate blade portion of said stair riser template member includes a plurality of measurement markings being spaced along a longitudinal edge thereof.

7. An adjustable template tool for stairways as described in claim 4, wherein a longitudinal slot is formed along the longitudinal axis of said support assembly for permitting said adjustment of the pivot point of said stair tread template member along said longitudinal axis.

8. An adjustable template tool for stairways as described in claim 1, wherein said stair tread template member has a longitudinal slot being disposed through said elongate handle portion with a fastener being disposed in said longitudinal slot of said stair tread template member and being disposed through a longitudinal slot formed in said support assembly along a longitudinal axis of said support assembly.

9. An adjustable template tool for stairways as described in claim 1, wherein said elongate blade portion of said stair tread template member includes a plurality of measurement markings being spaced along a longitudinal edge thereof.

10. An adjustable template tool for stairways comprising:

an elongate support assembly;

a stair riser template member being pivotally mounted to said elongate support assembly with a fastening member; and a stair tread template member being pivotally mounted to said elongate support assembly with a fastener;

wherein each of said template members has an elongate handle portion and an elongate blade portion, longitudinal axes of said handle and blade portions of each of said template members being oriented at an angle with respect to each other, said handle portion and said blade portion of each of said template members being fixedly connected to each other such that said angle between the longitudinal axes of said portions of each of said template members are unchangeable;

wherein said elongate support assembly includes a first and second elongate support members with each including a main wall, and also including a longitudinal slot being disposed through an end portion of said main wall, and further including a hole being disposed through another end portion of said main wall, and also including spacer members being disposed between said first and second elongate support members with said first and second elongate support members being spaced apart and being fastened to each other;

wherein each of said first and second elongate support members further includes a longitudinal flange extending outwardly from a bottom of said respective main wall and extending along a length of said main wall;

wherein each of said template members are pivotable about a respective pivot point, a pivot point of said stair riser template member being fixed at a position along a longitudinal axis of said support assembly and a pivot point of said stair tread template member being adjustable along the longitudinal axis of said support assembly such that a distance between the pivot point of said stair riser template member and the pivot point of said stair tread template member is adjustable;

wherein said stair riser template member has a longitudinal slot being disposed through said elongate handle portion with a fastening member being disposed in said longitudinal slot of said stair riser template member and being disposed through said hole in said support member;

wherein said elongate blade portion of said stair riser template member includes a plurality of measurement markings being spaced along a longitudinal edge thereof;

wherein a longitudinal slot is formed along the longitudinal axis of said support assembly for permitting said adjustment of the pivot point of said stair tread template member along said longitudinal axis;

wherein said stair tread template member has a longitudinal slot being disposed through said elongate handle portion with a fastener being disposed in said longitudinal slot of said stair tread template member and being disposed through said longitudinal slot in said support assembly along the longitudinal axis of said support assembly; and wherein said elongate blade portion of said stair tread template member includes a plurality of measurement markings being spaced along a longitudinal edge thereof.

* * * * *